United States Patent [19]

Caveney et al.

[11] 4,195,902

[45] Apr. 1, 1980

[54] ELECTRICAL CONNECTOR HAVING AN EXTENSIBLE, COLLAPSIBLE INSULATIVE SLEEVE

[75] Inventors: Jack E. Caveney, Hinsdale; Dale P. Brauer, Chicago Heights; William G. Cesaro, Country Club Hills; John J. Bulanda, New Lenox, all of Ill.

[73] Assignee: Panduit Corp., Tinley Park, Ill.

[21] Appl. No.: 885,425

[22] Filed: Mar. 13, 1978

[51] Int. Cl.[2] ..... H01R 13/12

[52] U.S. Cl. ..... 339/258 S; 174/DIG. 8; 339/DIG. 1

[58] Field of Search ..... 339/256 SP, 258 S, DIG. 1; 174/DIG. 8

[56] References Cited

U.S. PATENT DOCUMENTS

| | | | |
|---|---|---|---|
| 3,513,429 | 5/1970 | Helsop | 339/DIG. 1 |
| 3,662,094 | 5/1972 | Wetmore et al. | 339/DIG. 1 |

*Primary Examiner*—Joseph H. McGlynn

*Attorney, Agent, or Firm*—Charles R. Wentzel; Richard B. Wakely

[57] ABSTRACT

An electrical connector adapted to be mechanically joined to the stripped end of a wire for completing an electrical connection between the wire and another circuit component. The connector includes a metallic connector element and an insulative sleeve formed of heat shrinkable material. The connector element has a connector portion for mechanical connection to the circuit component and a wire-receiving portion spaced from the connector portion for accepting the wire and having a part for being mechanically joined to the wire. One end of the sleeve is disposed about and held by the connector portion with the other end of the sleeve disposed between the one end of the sleeve and the part of the wire-receiving portion of the element. The sleeve has a memory characteristic that upon application of heat the sleeve extends axially and shrinks radially whereby the wire-receiving end can be joined to the wire without interference from the sleeve and the subsequent application of heat to the sleeve causes it to extend over and shrink about the wire-receiving end of the element. As a method of applying an insulative sleeve about an electrical connector, the invention includes several steps. One end of the sleeve, which is formed from a length of insulative heat shrinkable tubing, is fixed about the connector portion of the element with the other end of the sleeve extending toward but terminating short of the part of the wire-receiving portion to be joined to the wire. The other end of the sleeve has a memory characteristic so that upon selective application of heat it extends axially and shrinks radially. Next the wire and the wire-receiving portion are mechanically joined. Finally the periphery of the other end of the sleeve is progressively heated from adjacent the one end of the sleeve toward the wire-receiving portion until the other end of the sleeve extends over and contracts about the wire-receiving portion.

3 Claims, 12 Drawing Figures

ELECTRICAL CONNECTOR HAVING AN EXTENSIBLE, COLLAPSIBLE INSULATIVE SLEEVE

BACKGROUND OF THE INVENTION

This invention relates to electrical connectors and, more particularly, to a connector having a metallic connector element only part of which is initially encompassed by an insulative sleeve which has a memory characteristic in that the sleeve is responsive to the selective application of heat thereto to extend axially and contract radially to insulate a previously non-insulated portion of the connector element.

A common method of insulating an electrical connector, e.g., a female disconnect, is to mechanically drive a sleeve of thermoplastic material, sized for an interference fit, over the connector. A sleeve is applied in this method typically only before the wire barrel of the connector is crimped to a wire because, after crimping, the extending wire makes the connector unwieldy and difficult to hold firmly. While such insulated connectors have been widely accepted they have the shortcoming that the crimping force required to mechanically join the connector to a wire is greater than that required to merely deform the malleable connector barrel about the wire since the insulated sleeve, in addition to the barrel, must be deformed. Also a burr or piece of foreign matter on the crimping jaws could result in piercing of the sleeve. Another disadvantage of a preinsulated connector is that a portion of the sleeve could be overstressed during crimping causing a nonuniformity of dielectric constant thereby requiring the sleeve to have increased thickness to insure provision of the necessary insulation characteristics.

In another method of insulating a connector element two insulated sleeve halves joined along one margin are folded to enclose the element. The other sides of the halves either have interlocking latch means or they are sonically welded together. It will readily be appreciated that this method includes many steps and is expensive.

Other methods of insulating a connector element have been proposed wherein an external yoke holds a sleeve in axial compression about the center portion of a butt splice connector to permit crimping the ends thereof before removal of the yoke, or wherein a wire crimp barrel has means holding an elastic sleeve extending away from the barrel portion to be crimped so that after crimping the sleeve can be folded over the crimped portion. These methods require additional components for holding the sleeve and rely upon the resiliency of the insulative sleeve to hold the sleeve in engagement with the crimped barrel portion. Examples of such connector insulation methods are shown in U.S. Pat. Nos. 2,674,647 and 3,011,010.

It is also known to insulate a connector element, after it has been crimped to a wire, by positioning a sleeve of heat shrinkable tubing about the element and heating the tubing until it radially contracts about the element. Of course, the sleeve represents a loose piece the user must keep track of and manipulate about the element. Also care must be taken to accurately locate the sleeve relative to the element so that post-shrinking the element is fully insulated. Reference may be made to U.S. Pat. Nos. 3,220,807 and 3,662,094.

SUMMARY OF THE INVENTION

Among the several objects of this invention may be noted the provision of an improved insulated connector which permits mechanical connection of the crimp barrel and the wire without interference from the insulative sleeve, thereby avoiding damage to the sleeve if the joining operation occurred with the sleeve disposed about the crimp barrel; the provision of such a connector which securely holds the sleeve to reduce the number of parts susceptible to loss and reduce manipulation required of the user; the provision of such a connector which is responsive to the selective application of heat to fully insulate the wire barrel and which insures proper positioning of the sleeve; and the provision of such a connector which is reliable in use, has long service life, and is simple and inexpensive to manufacture. Other objects and features of the present invention will be in part apparent and in part pointed out hereinafter in the specification and claims.

BRIEF DESCRIPTION OF THE DRAWINGS

Like reference characters indicate corresponding components throughout the several drawings.

DESCRIPTION OF THE PREFERRED EMBODIMENT

Figure 1:
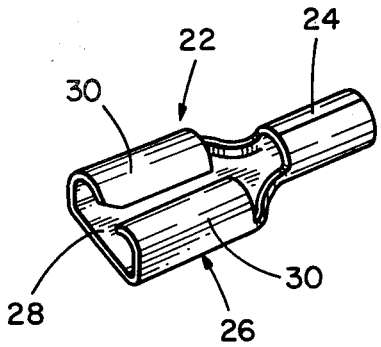
FIG. 1 is a perspective of the connector element of a female disconnect including a connector portion and a wire-receiving portion.
Figure 2:
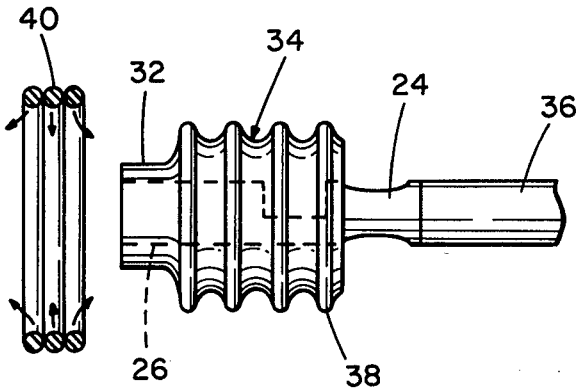
FIG. 2, is a side elevation of an insulative sleeve disposed about the connector portion and extending toward the wire-receiving portion which has been joined to a wire.

Referring now to the drawings, an electrical connector adapted to be mechanically joined to the stripped end of a wire for completing an electrical connection between the wire and another circuit component is generally indicated in FIG. 2 by reference numeral 20. Connector 20 includes a connector element 22, best shown in FIG. 1, having a wire-receiving portion or barrel 24 and a connector portion 26 including a floor 28 and spring arms 30 which cooperate to receive and compressively hold the blade end of a male disconnect (not shown). Wire-receiving portion 24 has a part, shown by the indentations in FIGS. 2–4, adapted to be deformed by a crimping tool to mechanically join portion 24 to the wire.

Figure 3:
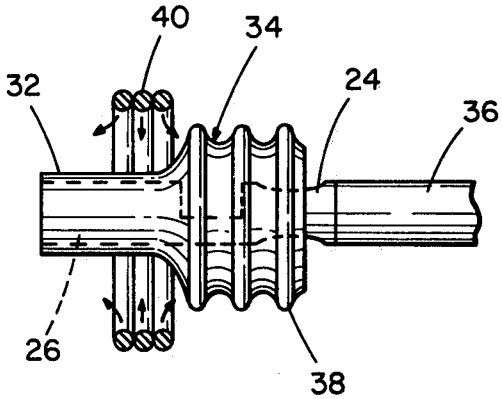
FIG. 3, similar to FIG. 2, shows the sleeve extending toward the wire-receiving portion in response to the application of heat to the sleeve.

Disposed about connector portion 26 is one end 32 of an insulated sleeve 34 formed of heat shrinkable material and which is responsive to the selective application of heat to extend axially and contract radially about barrel 24 after the barrel is crimped about wire 36 as shown in FIG. 3. By "heat shrinkable" is meant that sleeve 34 has the memory characteristic of radially shrinking in response to the application of heat. This characteristic is imparted by cross-linking the molecules forming the sleeve when the sleeve has its desired final configuration which is also termed heat stable condition. Cross-linking can be effected by irradiation, bombarding the material by high energy electrons, or by chemical methods. After cross-linking, the material is heated above its transition temperature and expanded. By supporting the material in its expanded or heat unstable condition while the material cools below its transition temperature the stresses resulting from cross-linking are "frozen", to be released by heating the material above its transition temperature. A process and apparatus from producing materials having configurational memory is described in U.S. Pat. No. 3,086,242. As will be described more fully hereinafter, sleeve 34 not only has the memory characteristic that it will radially contract in response to heating but also has been imparted with the memory characteristic of axial extension effected by heating. Thus relative to its heat stable or cross-linked configuration, sleeve 34, in its heat unstable condition, has an increased cross-sectional dimension and a lesser axial dimension.

As shown in FIG. 2, one end 32 of sleeve 34 is frictionally held by connector portion 26. This tight frictional engagement is achieved either by sizing end 32 for a frictional fit and pushing sleeve 32 over portion 26 or by positioning the end 32 about portion 26 so that the remainder or enlarged other end 38 of the sleeve, which is shown as having accordion pleats or corrugations resulting from axial compression, extends towards barrel 24 and applying heat to end 32 resulting in its radial contraction.

Figure 4:
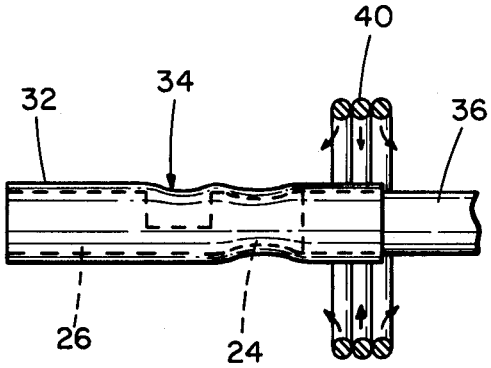
FIG. 4, also similar to FIG. 2, illustrates the connector with the sleeve fully axially extended and radially shrunk to fully insulate the wire-receiving portion.

Operation of the connector of the present invention is as follows: After barrel 24 has been mechanically joined to wire 36, a heat emitting device 40, e.g., an electrical resistance heater, is placed to heat the periphery of the enlarged other end 38 of sleeve 34 adjacent end 32. As end 38 begins to axially extend while radially contracting, see FIG. 3, heater 40 is advanced toward and over barrel 24 until the previously non-insulated barrel is fully insulated as shown in FIG. 4. Although the connector 20 above-described is a female disconnect, it will be readily appreciated that sleeve 34 can be advantageously used with a plurality of types of connector elements, for example, rings, forks, blades and butt splices. Additionally, sleeve 34 can be used not only with a connector having a closed barrel 24 but also a connector having an open barrel, the arms of which are bent toward one another to hold the wire.

Figure 5:
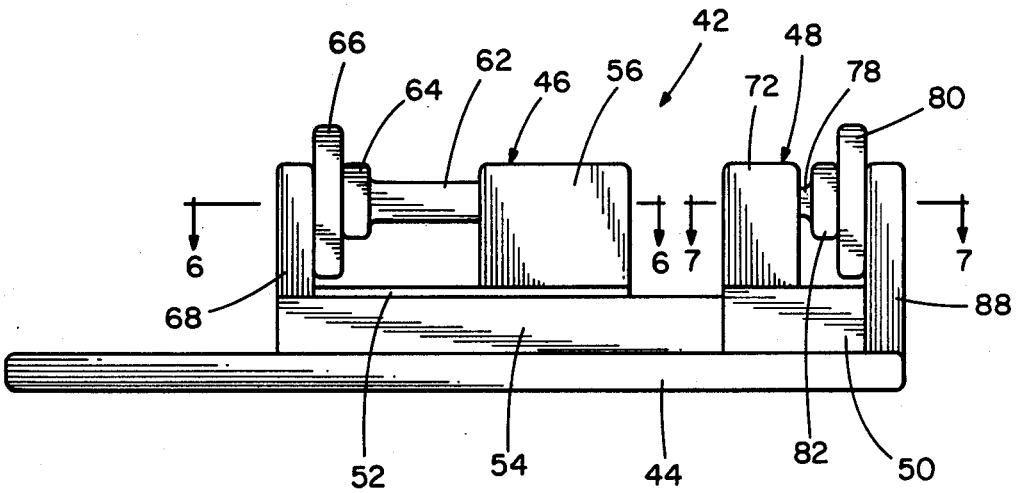
FIG. 5 is a front elevational view of apparatus for axially compressing a length of heat shrinkable tubing to form the connector sleeve, the fixture including a compressor assembly and a stripper assembly.
Figure 7:
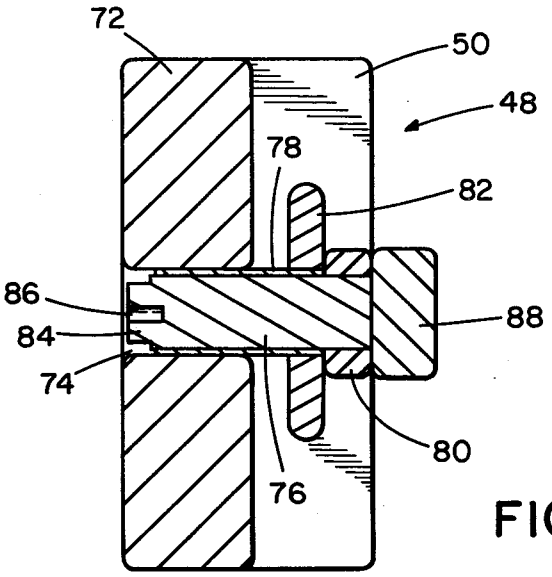
FIG. 7 is a sectional view of the stripper assembly which includes a mandrel, a stripper sleeve, and a stripper chamber, taken generally along line 7—7 of FIG. 5.
Figure 8:
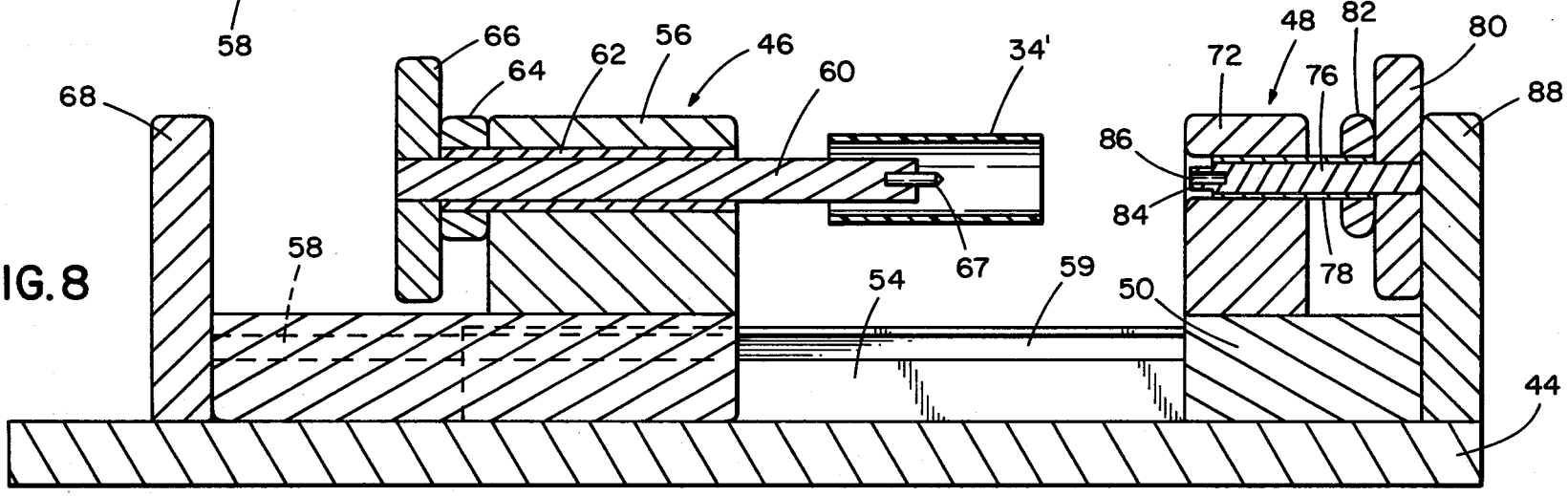
FIG. 8 is a sectional view of the fixture of FIG. 5 showing the compressor assembly spaced from the stripper assembly and the arbor extended to receive a length of tubing.
Figure 11:
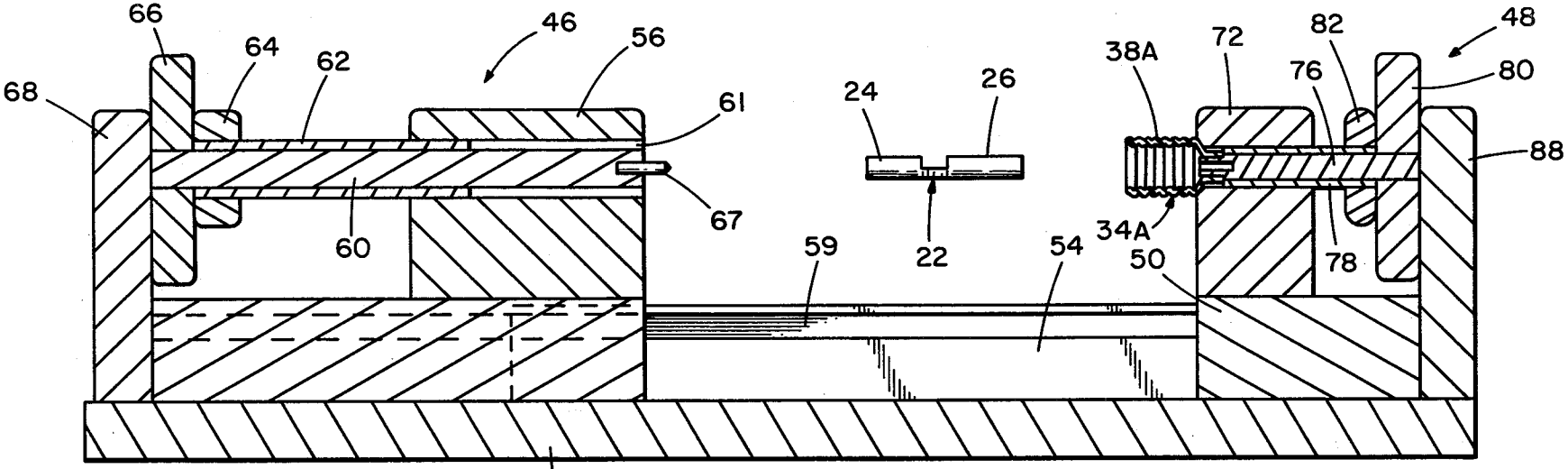
FIG. 11, similar to FIG. 8, illustrates the compressor assembly remote from the stripper assembly with the sleeve held by the mandrel.
Figure 12:
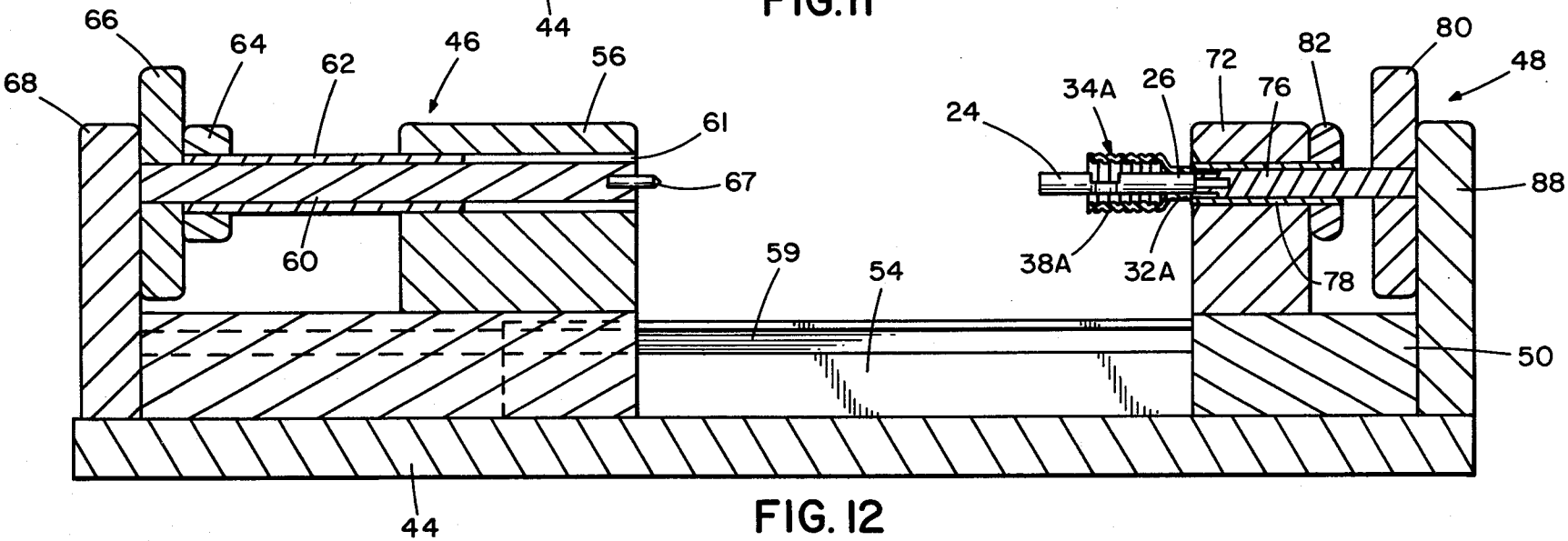
FIG. 12, also similar to FIG. 8, shows the stripper sleeve advancing to push the sleeve from the mandrel and over the connector portion of the connector element.

Referring now to FIGS. 5 and 8, manually operated apparatus for axially compressing a length of heat shrinkable tubing 34', see FIG. 8, to form a sleeve 34A, shown in FIGS. 11 and 12, is generally indicated in FIG. 5 by reference numeral 42. Components of sleeve 34A similar to previously described components of sleeve 34 are designated by the suffix "A". Sleeve 34A is similar to sleeve 34 except for the number of pleats in end 38. Apparatus 42 comprises a base 44, a sleeve compressor assembly 46 (best shown in FIG. 6) and a sleeve stripper assembly 48 (best shown in FIG. 7), the latter assembly including a floor 50 fixedly mounted to base 44 by means of bolts or the like while the compressor assembly has a floor 52 slidably supported by a pair of spaced guide tracks 54 which are fixed to base 44 thereby permitting reciprocal movement of compressor assembly 46 relative to stripper assembly 48.

Figure 6:
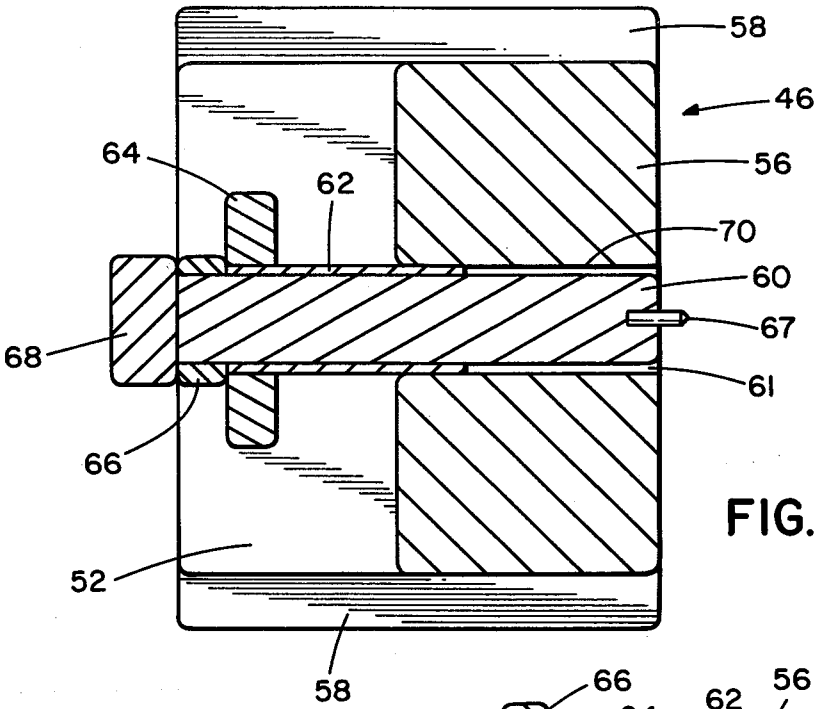
FIG. 6 is a sectional view of the compressor assembly which includes an arbor, a compression sleeve and a compression chamber, taken generally along line 6—6 of FIG. 5.

More specifically and with reference to FIG. 6, compressor assembly 46 comprises a compressor block 56 fixed to floor 52 which has laterally extending tongues 58 for reception within respective elongate grooves 59, see FIG. 8, in respective guide tracks 54. Block 56 is provided with an elongate chamber 61 of generally rectangular cross section receiving an arbor 60 and, telescopically disposed about the arbor, a compressor sleeve 62, the last-mentioned two components, also having generally rectangular cross sections, being slidable relative to one another as well as to compressor block 56. Arbor 60 receives tubing 34' and has a greater cross-sectional area than the cross-sectional area bound by the tubing in its heat stable condition. One end of sleeve 62 is press fit into a rectangular boss 64 having its major dimension in the horizontal direction while one end of arbor 60 is press fit into a generally rectangular flange 66 having its major extension in the vertical direction, the remaining end of the arbor having an elongate bore receiving a key 67 for alignment with components of stripper assembly 48. The boss and flange are provided to facilitate operator positioning of the arbor and compressor sleeve and the compressor assembly further includes an abutment standard 68 for limiting retraction of the arbor and compressor sleeve to preclude their removal from chamber 61. As will appear more fully hereinafter, arbor 60, compressor sleeve 62, and the inner wall 70 of compressor block 56 defining chamber 61 constitute, respectively, means for receiving length of tubing 34', means for engaging an end of tubing 34' to axially compress it, and means for limiting the outward radial movement of the outer surface of the tubing.

Referring now to FIG. 7, stripper assembly 48 includes a stripper block 72, fixed to floor 50, having an elongate chamber 74 of generally rectangular cross section which receives a mandrel 76 and, telescopically disposed about the mandrel, a stripper sleeve 78, the mandrel and sleeve also preferably having a generally rectangular cross section to prevent their rotation relative to block 72. Mandrel 76 and sleeve 78 are slidable relative to one another and the stripper block. As with arbor 60 and compressor sleeve 62, the ends of mandrel 76 and stripper sleeve 78 are press fit, respectively, into a flange 80 and a boss 82 having non-coincidental directions of major extension to permit the operator to independently move the mandrel and stripper sleeve. The remaining end 84 of the mandrel is of reduced cross section and constitutes means for seating and holding one end of tubing 34' against axial movement as the tubing is compressed. Mandrel end 84 includes a keyway 86 for receiving key 67 to insure alignment of the mandrel and the arbor. Stripper assembly 48 further includes an abutment standard 88 fixed to stripper assembly floor 50 for limiting retraction of the mandrel and stripper sleeve to prevent their inadvertent removal from stripper chamber 74. As will appear more fully hereinafter, mandrel 76 and stripper sleeve 78 constitute, respectively, means for holding one end of the tubing and means for stripping the tubing end from the mandrel.

Figure 9:
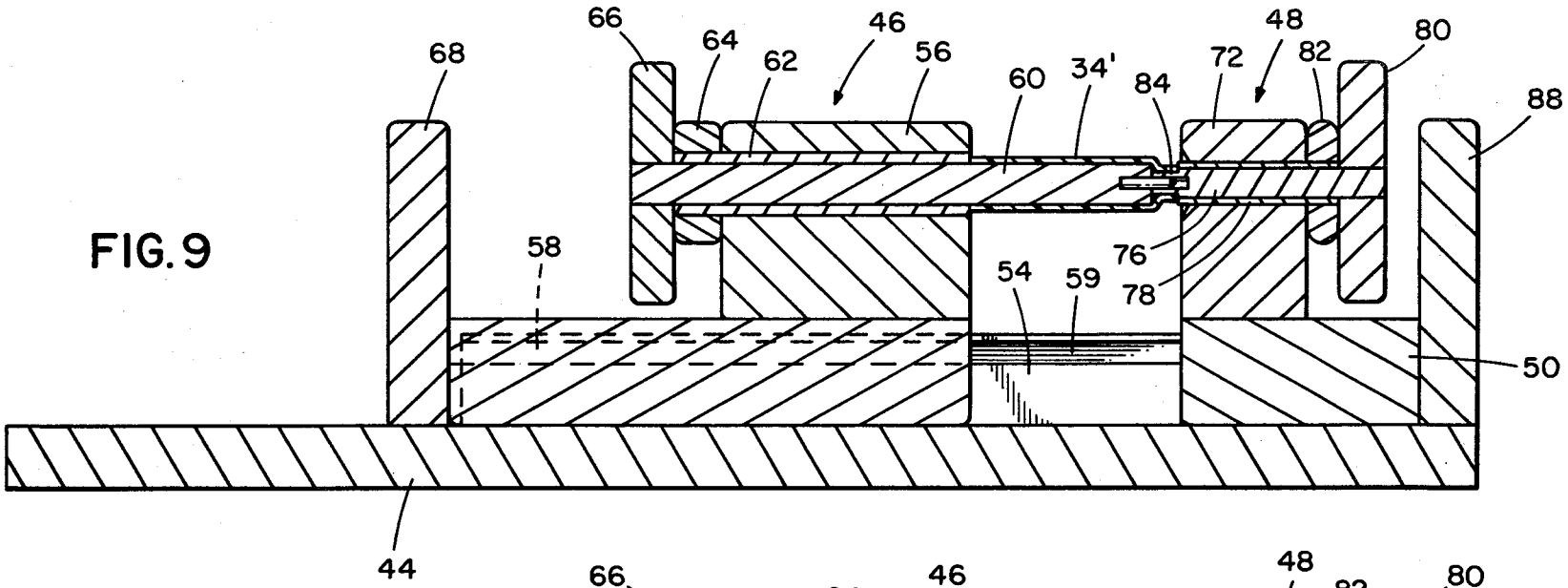
FIG. 9, similar to FIG. 8, illustrates the mandrel extending into and holding one end of the length of tubing.

Operation of compression apparatus 42 is as follows: With reference to FIG. 8, with compressor assembly 46 positioned remote from stripper assembly 48 and with arbor 60 extending from compressor block 56, the length of tubing 34', preferably made of polyolefin which has a transition temperature of about 135° C. (275° F.), is placed over the arbor. As shown in FIG. 9, the mandrel 76, is extended and the compressor assembly advanced until key 67 is received by keyway 86. With one end of tubing 34' disposed about mandrel end 84, the tubing end is heated until it radially shrinks about the mandrel end. The remainder of the tubing is then heated above its transition temperature by heating the arbor by means such as an electrical resistance heating element embedded in the arbor (not shown) to preferably a temperature of about 177° C. (350° F.); however, the outside surface of arbor 60 holds the tubing from contracting to its heat stable condition and constitutes means for limiting the inward radial movement of the inner surface of the tubing.

Figure 10:
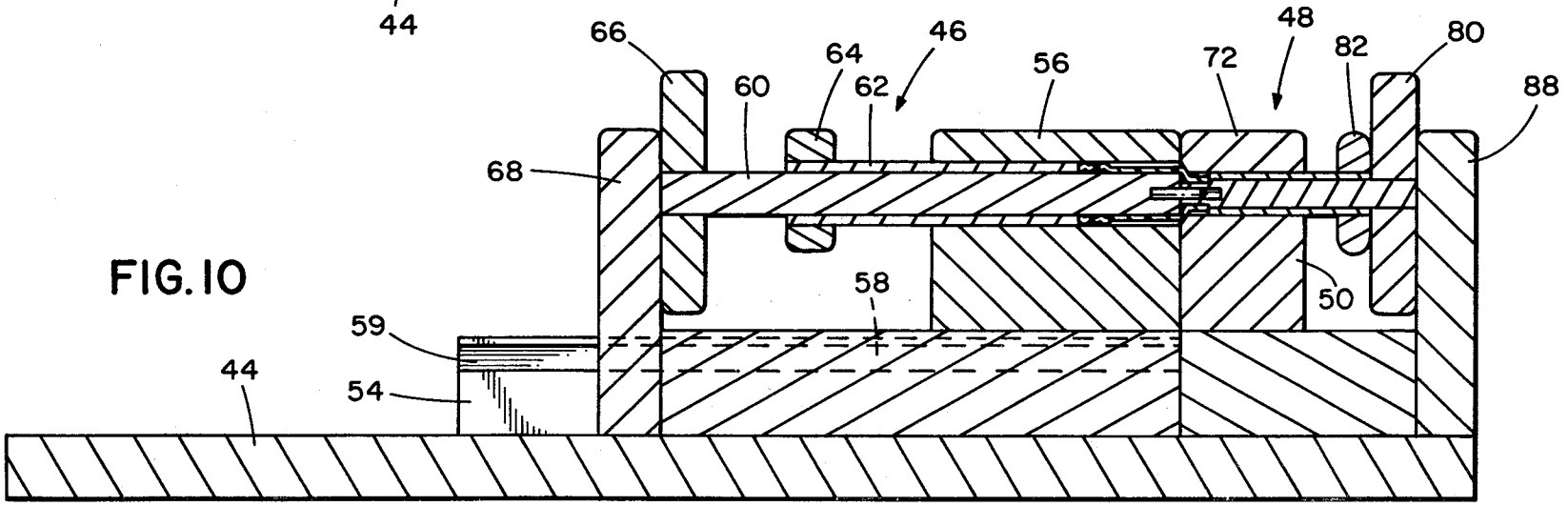
FIG. 10, similar to FIG. 8, shows the compression chamber and stripper chamber contiguous with the compressor sleeve advancing to axially compress the length of tubing to form the connector sleeve.

Referring next to FIG. 10, with the tubing still above its transition temperature, the compressor assembly is further advanced until compressor block 56 abuts stripper block 72. Compressor sleeve 62 is advanced causing tubing 34' to axially compress and advancement is continued until the sleeve 34A is formed. The compressor sleeve is pinned in its extended position by clamps or the like (not shown) and sleeve 34A is permitted to cool below its transition temperature to "freeze" its configuration. After cooling, the compressor assembly is moved away from the stripper assembly as the compressor sleeve is extended to free sleeve 34A from the compressor chamber.

With the sleeve 34A held extending from the mandrel as shown in FIG. 11, the connector portion of the connector element is aligned and abutted against the mandrel end 84. As shown in FIG. 12, extension of the stripper sleeve 78 forces the trailing end 32A of sleeve 34A over the connector portion with the remainder of the sleeve extending toward the wire barrel. While apparatus 42 has been described as manually operated, it will be obvious to one skilled in the art to provide various drive means, such as air cylinders, and a control circuit for automatically sequencing the various components of apparatus 42 through the above-described cycle of operation.

In view of the above, it will be seen that the several objects of the present invention are achieved and other advantageous results attained.

As various changes could be made in the above constructions without departing from the scope of the invention, it is intended that all matter contained in the above description shall be interpreted as illustrative and not in a limiting sense.

What is claimed is:

1. An electrical connector adapted to be mechanically joined to the end of a wire for completing an electrical connection between said wire and another circuit component, said connector comprising:

a metallic connector element comprising a connector portion for mechanical connection to said circuit component, and a wire-receiving portion spaced from said connector portion for accepting said wire and having a part for being mechanically joined to said wire; and an insulative sleeve formed of heat-shrinkable material, one end of said sleeve being disposed about and held by said connector portion with the other end of said sleeve disposed between said one end and said part of the wire-receiving portion of said element, said sleeve having a memory characteristic so that upon application of heat said sleeve extends axially and shrinks radially, whereby said wire-receiving portion can be joined to said wire without interference from said sleeve and the subsequent application of heat to said sleeve causes said sleeve to extend over and shrink about the wire-receiving portion of said element, said other end of said sleeve having, in its heat unstable condition, an accordion pleat.

2. An electrical connector as set forth in claim 1 wherein said connector element is a female disconnect the wire-receiving portion of which is a malleable barrel adapted to be crimped about said wire.

3. An electrical connector as set forth in claim 1 wherein said sleeve is formed of polyolefin.

* * * * *